United States Patent [19]

Metropulos

[11] Patent Number: 4,491,359

[45] Date of Patent: Jan. 1, 1985

[54] CADDY FOR SKIS, POLES AND BOOTS

[76] Inventor: Robert P. Metropulos, 6218 Ridgeway Dr., Lake Tomahawk, Wis. 54539

[21] Appl. No.: 471,273

[22] Filed: Mar. 1, 1983

[51] Int. Cl.[3] ..... A63C 11/02

[52] U.S. Cl. ..... 294/147; 294/143; 294/165

[58] Field of Search ..... 294/141–143, 294/146, 147, 149, 151, 153, 154, 159, 161–163, 165, 167, 169, 170; 211/60 SK; 224/917; 280/814, 815

[56] References Cited

U.S. PATENT DOCUMENTS

| | | | |
|---|---|---|---|
| 3,086,688 | 4/1963 | Vikre | 294/163 |
| 3,307,759 | 3/1967 | Fulton | 294/147 |
| 3,718,242 | 2/1973 | Larson | 294/143 X |
| 3,877,623 | 4/1975 | Breault | 294/147 |
| 3,985,275 | 10/1976 | Allen | 280/814 |
| 3,990,655 | 11/1976 | Covell | 294/141 X |
| 4,040,551 | 8/1977 | Brumbaugh | 294/147 |
| 4,190,182 | 2/1980 | Hickey | 294/147 |

FOREIGN PATENT DOCUMENTS

| | | | |
|---|---|---|---|
| 2358171 | 3/1978 | France | 280/814 |
| 68355 | 10/1944 | Norway | 280/814 |

*Primary Examiner*—Johnny D. Cherry

*Attorney, Agent, or Firm*—Harvey B. Jacobson

[57] ABSTRACT

A main horizontally elongated body is provided including a handle intermediate its opposite ends engageable from above. The opposite end portions of the body each include opposite side ski support structures dependingly supported therefrom whereby each ski of a pair of skis may have longitudinally spaced portions thereof supported from the ski support structures on a corresponding side of the body. The ski support structures each include a pair of vertically elongated inner and outer arms between which to snugly receive a corresponding ski in edge upstanding horizontal position with the ski bottom surfaces opposing each other in horizontally spaced apart relation. The upper ends of the ski support structures are supported from the body for upward and outward swing of the lower ends of the ski support structures toward generally horizontal positions and each of the outer arms is pivotally supported at its upper end for swinging toward and away from the corresponding inner arm.

6 Claims, 3 Drawing Figures

CADDY FOR SKIS, POLES AND BOOTS

BACKGROUND OF THE INVENTION

In many instances, a skier wishes to carry his skis, poles and boots in a convenient manner and various supporting structures heretofore have been provided for this purpose. However, skiers often must contend with theft of their skis and/or poles and, accordingly, a need exists for a carrier for skis, poles and boots which may function to lock the skis and poles to the carrier and also the carrier relative to a suitable anchored structure to thereby prevent theft of either the skis or the poles.

BRIEF DESCRIPTION OF THE INVENTION

The caddy of the instant invention includes structure thereon for removably anchoring a pair of skis thereto as well as a pair of ski poles thereto and further is constructed in a manner whereby the skis anchored thereto may be supported in slightly spaced apart bottom edge opposing relation. In this manner, a pair of ski boots may be supported from the skis in the usual positions thereon, with the ski boots projecting outwardly from the remote sides of the associated skis.

The carrier further includes a cable lock assembly whereby the skis and poles supported therefrom may be locked against displacement from the carrier and the carrier may be anchored relative to a suitable stationary anchor structure. In addition, the portions of the carrier from which the associated skis are to be supported are mounted from the remainder of the carrier for swinging movement to positions with the skis disposed in side-by-side bottom surface downward facing positions and in this manner, the carrier, skis and poles may be supported from a suitable vehicle-mounted ski carrier in the usual manner.

The main object of this invention is to provide a ski caddy or carrier for removable support of skis and ski poles therefrom in a manner such that the skis and ski poles may not be removed from the carrier by unauthorized persons.

Another object of this invention is to provide a ski carrier in accordance with the preceding object and including lock structure for retaining the associated skis and ski poles thereon and also for locking the carrier itself relative to a suitable stationary anchor structure.

Still another object of this invention is to provide a ski carrier in accordance with the preceding objects and constructed in a manner whereby the skis supported therefrom may be swung to side-by-side lower surface downwardly facing positions, thus enabling the ski carrier, the skis and poles supported therefrom to be carried on a conventional vehicle-mounted ski carrier.

Yet another object of this invention is to provide a ski carrier which may support skis, ski poles and ski boots therefrom in a manner such to prevent injury to the skis, poles or boots.

A final object of this invention is to be specifically enumerated herein is to provide a ski caddy in accordance with the preceding objects and which will conform to conventional forms of manufacture, be of simple construction and easy to use as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
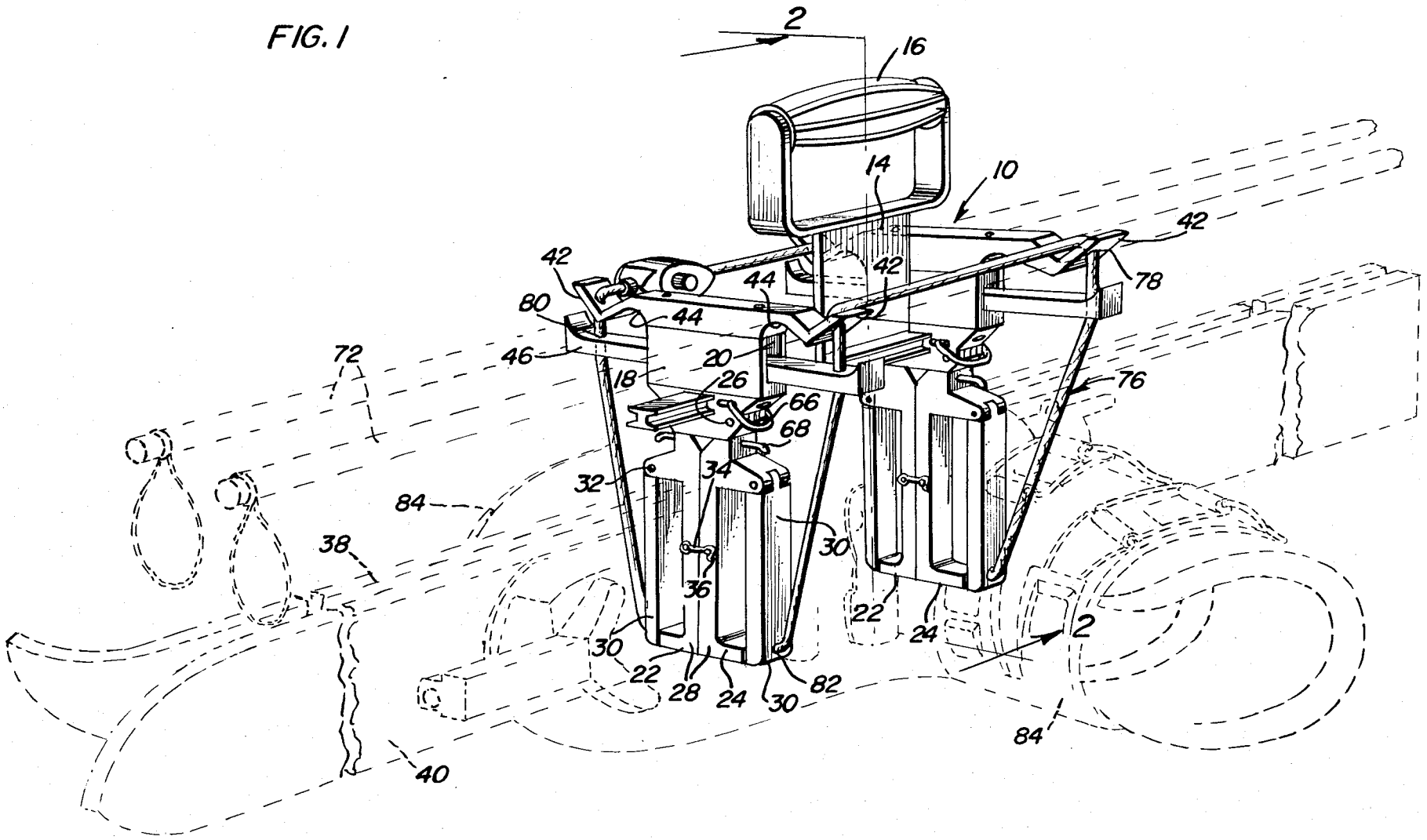
FIG. 1 is a perspective view of the ski caddy with associated skis, ski boots and ski poles illustrated in phantom lines.

Referring now more specifically to the drawings, the numeral 10 generally designates the ski caddy of the instant invention. The ski caddy 10 includes an elongated shape retentive body 12 including an upwardly projecting standard 14 intermediate its opposite ends atop which a longitudinally extending handgrip 16 is supported. Opposite end portions of the body 12 include mounting blocks 18 supported therefrom and each mounting block 18 includes a transverse passageway 20 formed therethrough. The lower portion of each mounting block supports a pair of ski clamps 22 and 24 therefrom for oscillation relative thereto about a horizontal longitudinally extending axis as at 26 and each clamp 22 and 24 is outwardly and upwardly swingable from the solid line position thereof illustrated in FIGS. 1 and 2 toward the upper horizontal phantom line positions thereof illustrated in FIG. 2.

Each ski clamp 22, 24 includes a horizontally outwardly opening horizontal channel member 28 comprising an inner arm and an outer arm 30 pivotally supported from the corresponding inner arm as at 32 for oscillation about a horizontal axis extending longitudinally of the body 12. In addition, the inner arm of each clamp 22, 24 includes a hook 34 supported therefrom removably engageable with a keeper 36 carried by the inner arm 28 of the corresponding ski clamp 22, 24. As may best be seen from FIG. 1 of the drawings, a pair of skis 38 and 40 may be supported from the ski clamps 22 and 24 supported from opposite sides of the mounting blocks 18 with the undersurfaces of the skis 38 and 40 disposed in closely spaced apart opposing relation.

Figure 3:
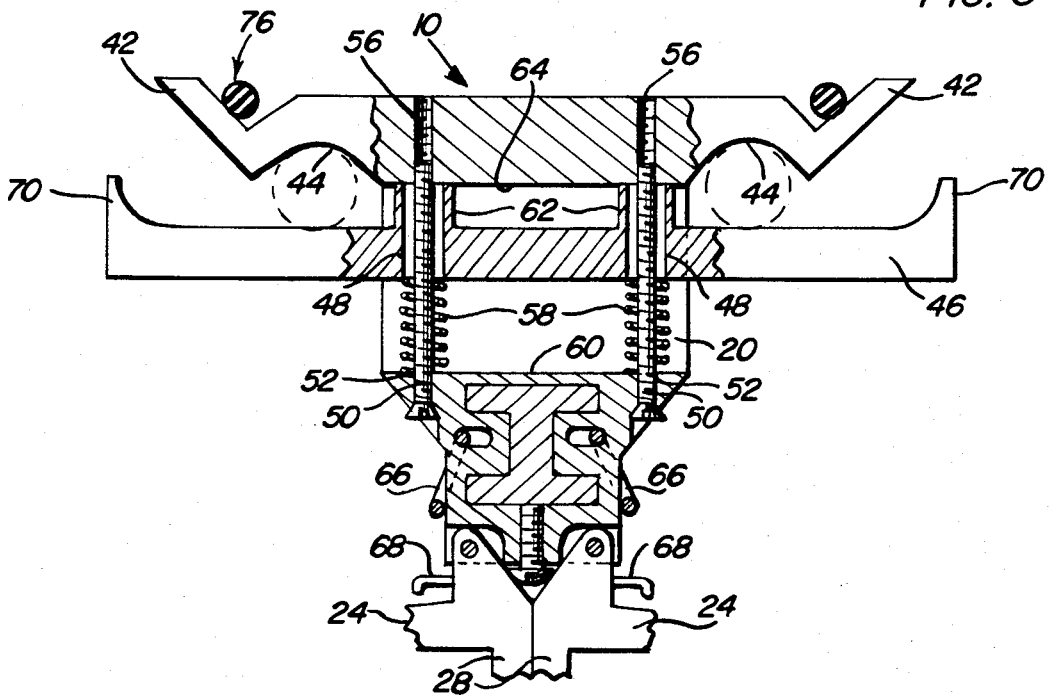
FIG. 3 is a fragmentary enlarged vertical sectional view illustrating the ski pole attaching structure of the carrier in greater detail.

The upper portions of the mounting blocks 18 include oppositely outwardly directed arms 42 defining downwardly opening recesses 44 and each of the passageways 20 has a horizontal transverse support bar 46 projecting therethrough and including opposite ends disposed beneath and opposing the corresponding pairs of arms 42. The support bars 46 include vertical passageways 48 formed therethrough which loosely receive the threaded shank portions of threaded fasteners 50 therethrough. The fasteners 50 are secured upwardly through smooth bores 52 formed in lower portions of each mounting block 18 and threadedly engaged in threaded bores 56 formed in the upper portion of each mounting block 18. In addition, compression springs 58 are disposed about each of the fasteners 50 intermediate the corresponding support bar 46 and the bottom surface 60 of the associated passageway 20 to thus yieldingly upwardly bias the support bars 46 toward their uppermost limit positions shown in FIG. 3 of the drawings with upstanding sleeve portions 62 of the support bars 46 forming upward continuations of the bores 48 abutted against the upper wall 64 of the corresponding passageway 20.

Figure 2:
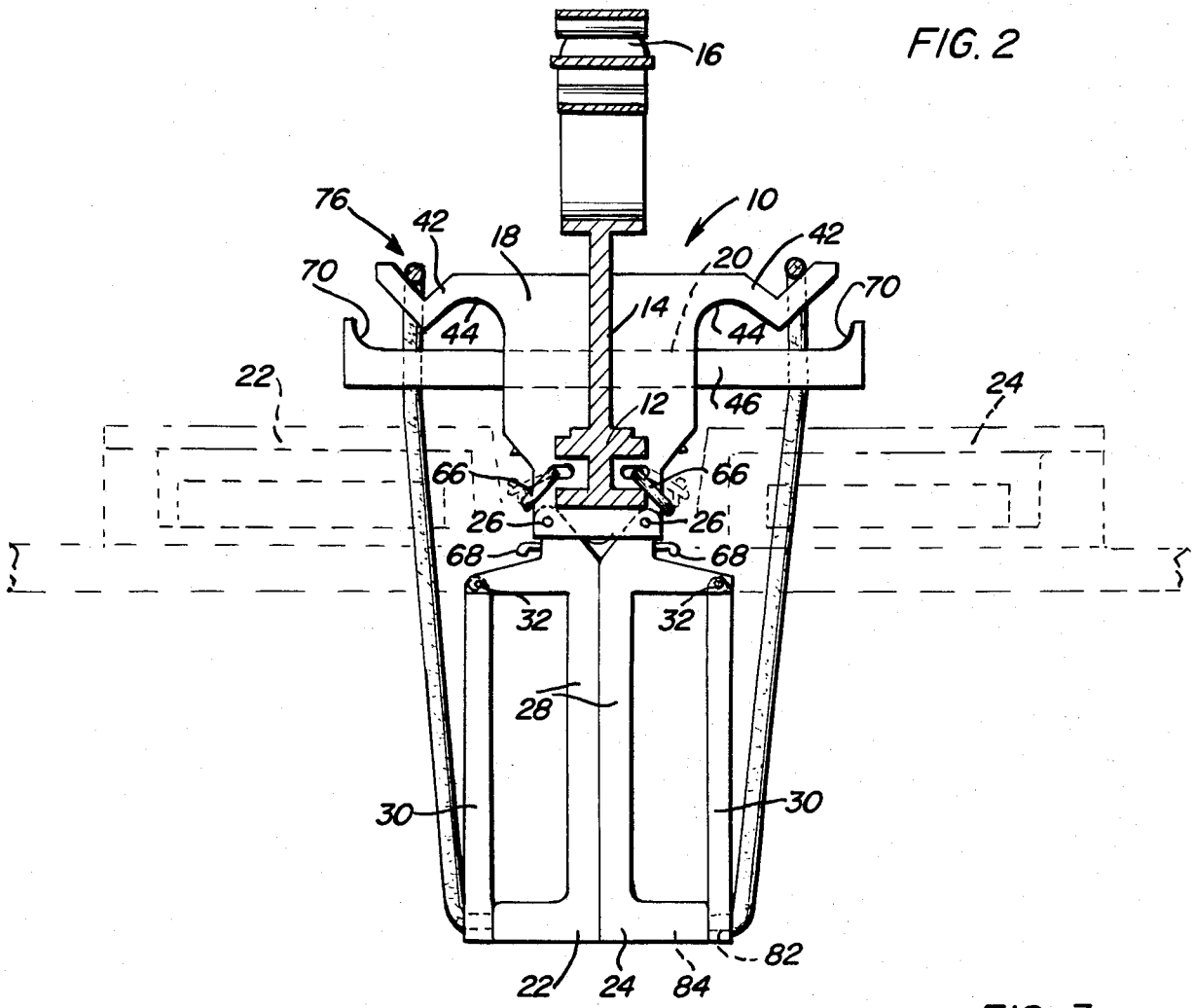
FIG. 2 is an enlarged fragmentary transverse vertical sectional view taken substantially upon the plane indicated by the section line 2—2 of FIG. 1 and illustrating an alternate position of the ski supporting structure of the caddy in phantom lines.

The mounting blocks 18 each include opposite side latch loops 66 slidably and pivotally supported therefrom and each inner arm 28 includes an outwardly projecting hook portion 68 adjacent its upper end with which the corresponding latch loop 66 may be engaged when the ski clamps 22, 24 are swung outwardly and upwardly toward the phantom line positions thereof illustrated in FIG. 2. Of course, the opposing surfaces of the inner and outer arms 28 and 30 may be suitably covered with a coating or material acting as a cushion to prevent the associated skis from being scratched or otherwise damaged.

The outer ends of the arms 42 are inclined upwardly and the outer ends of the support bar 46 are curved upwardly as at 70. Accordingly, a pair of ski poles 72 may have their longitudinal midportions clamp engaged between corresponding arms 42 and support bars 46 for support of ski poles 72 from the caddy 10. In addition, the outer arms 30 may be swung upwardly and outwardly relative to the inner arms 28 in order to receive a pair of skis 38 and 40 within the channel-shaped inner arms 28. Thereafter, the outer arms 28 may again be swung to the closed positions thereof illustrated in FIG. 1 of the drawings and a cable lock referred to in general by the reference numeral 76 may be threaded through appropriate bores 78 and 80 formed in the arms 42 and the opposite ends of the support bar 46, bores 82 formed through the lower ends of the outer arms 30 and bores 84 formed through the lower ends of the inner arms 24 in order to maintain the ski clamps 22 and 24 in their lower abutting solid line positions illustrated in FIG. 1 of the drawings, the outer arms 30 in their closed positions and the ski poles 72 seated within the recesses 44. In this manner, the caddy 10 is capable of supporting not only a pair of skis 38 and 40 therefrom but also a pair of ski poles 72 therefrom with the skis and ski poles 72 locked against disengagement from the ski caddy 10. Furthermore, a pair of ski boots 84 may be supported from the skis 38 and 40 in their usual positions from the ski bindings of the skis, thereby enabling the ski caddy 10 to support not only a pair of skis and a pair of ski poles, but also a pair of ski boots.

If it is desired to transport a pair of skis and ski poles supported from the caddy 10 as well as the caddy from a conventional ski rack or carrier mounted on a vehicle, the ski clamps 22 and 24 may be swung to the phantom line positions thereof illustrated in FIG. 2 of the drawings and latched in those phantom line positions through the utilization of the loops 66 and hooks or keepers 68. Thus, the caddy 10 need not have the skis or ski poles disengaged therefrom when the skis and poles are to be supported from a conventional vehicle-mounted ski rack.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A caddy for skis, poles and boots, said caddy including a main horizontally elongated shape retentive body, said body including handle means intermediate opposite ends engageable from above said body, the opposite end portions of said body each including opposite side ski support structures supported therefrom, whereby each ski of a pair of skis may have longitudinally spaced portions thereof supported from the ski support structures on a corresponding side of said body, said ski support structures each including a pair of dependingly supported vertically elongated inner and outer arms between which to snugly receive a corresponding ski in edge upstanding horizontal position and with the pairs of support structures disposed on opposite sides of said body aligned longitudinally of said body for support of longitudinally spaced portions of a single associated ski therefrom and with the bottom surfaces of a pair of skis supported from said support structures opposing each other in horizontally spaced apart relation, the upper portions of said support structures being pivotally supported from said body for outward and upward swinging of the lower end of said support structures from lower limit positions with corresponding opposite side inner arms abutted against each other through an arc of approximately 90° relative to said body toward generally horizontal positions wherein skis supported therefrom will be horizontally registered in laterally spaced apart relation and with the bottom surfaces of the skis facing downwardly, latch means operative to releasably latch said support structure in said generally horizontal positions, each of said outer arms being pivotally supported at its upper end for angular displacement relative to the corresponding inner arm about a horizontal axis extending longitudinally of said body for swinging movement of the lower end of each outer arm outward and upward away from the corresponding inner arms, said caddy including lock means operative to releasably lock said outer arms against outward and upward swinging movement relative to said corresponding inner arms.

2. The caddy of claim 1 wherein said lock means also includes means operative to lock said support structures against outward and upward swinging movement relative to said body.

3. The combination of claim 2 wherein said lock means comprises a single cable lock.

4. The caddy of claim 2 wherein the opposite ends of said body include opposite side outwardly projecting ski pole supporting structures and each pair of ski pole supporting structures disposed on a corresponding side of said body are adapted to embracingly receive longitudinally spaced portions of a ski pole therein.

5. The ski caddy of claim 4 wherein said lock means further includes means operative to prevent removal of ski poles supported from said ski pole supporting structures.

6. The caddy of claim 5 wherein said lock means also includes means operative to lock said caddy relative to a stationary anchor structure.

* * * * *